US012790924B2

(12) United States Patent
Jiang et al.

(10) Patent No.: US 12,790,924 B2
(45) Date of Patent: Nov. 10, 2026

(54) ULTRASONIC EXCITATION AND NITROGEN-INJECTION PRESSURIZATION COUPLING-ENHANCED GAS EXTRACTION DEVICE AND METHOD FOR LOW-GAS COAL SEAM

(71) Applicant: CHONGQING UNIVERSITY, Chongqing (CN)

(72) Inventors: Changbao Jiang, Chongqing (CN); Chen Jing, Chongqing (CN); Lin Li, Chongqing (CN); Jiayao Wu, Chongqing (CN); Hao Li, Chongqing (CN)

(73) Assignee: CHONGQING UNIVERSITY, Chongqing (CN)

( * ) Notice: Subject to any disclaimer, the term of this patent is extended or adjusted under 35 U.S.C. 154(b) by 0 days.

(21) Appl. No.: 19/339,784

(22) Filed: Sep. 25, 2025

(65) Prior Publication Data

US 2026/0103965 A1 Apr. 16, 2026

(30) Foreign Application Priority Data

Oct. 9, 2024 (CN) ..... 202411400852.X

(51) Int. Cl.
*E21B 43/16* (2006.01)

(52) U.S. Cl.
CPC ..... *E21B 43/168* (2013.01)

(58) Field of Classification Search
CPC ..... E21B 43/168; E21F 7/00
See application file for complete search history.

(56) References Cited

U.S. PATENT DOCUMENTS 7,073,587 B2 * 7/2006 Bassin ..... E21B 43/114 166/55
2014/0305877 A1 * 10/2014 Cioanta ..... E21B 43/26 134/1

FOREIGN PATENT DOCUMENTS

CN 113550784 B * 5/2022 ..... B01D 53/52
CN 110259427 B * 5/2023 ..... C09K 8/685
CN 117536619 A * 2/2024 ..... E21C 37/14

OTHER PUBLICATIONS

Ellison, C., Abdelsayed, V., Smith, M. and Shekhawat, D., 2022. Comparative evaluation of microwave and conventional gasification of different coal types: Experimental reaction studies. Fuel, 321, p. 124055. DOI: https://doi.org/10.1016/j.fuel.2022.124055 (Year: 2022).*

(Continued)

*Primary Examiner* — Theodore N Yao
(74) *Attorney, Agent, or Firm* — HOWARD M COHN and Associates, LLC

(57) ABSTRACT

The invention discloses an ultrasonic excitation and nitrogen-injection pressurization coupling-enhanced gas extraction device and method for a low-gas coal seam. The ultrasonic excitation and nitrogen-injection pressurization coupling-enhanced gas extraction device includes a permeability-enhancement borehole and at least two exploration boreholes. An extraction sieve tube is mounted in each of the boreholes. An ultrasonic excitation and nitrogen-injection pressurization coupling integrated device is mounted in the extraction sieve tube in the permeability-enhancement borehole. The invention increases the permeability of coal seams and the gas flow driving force of the coal seams, thus efficiently solving the problem of a failure of gas extraction from low-gas coal seams.

7 Claims, 1 Drawing Sheet

(56) References Cited

OTHER PUBLICATIONS

Ellison, C., Abdelsayed, V. and Smith, M.W., 2023. Analysis of char structure and composition from microwave and conventional pyrolysis/gasification of low and middle rank coals. Fuel, 354, p. 129301. DOI: https://doi.org/10.1016/j.fuel.2023.129301 (Year: 2023).*

Abdelsayed, V., Ellison, C.R., Trubetskaya, A., Smith, M.W. and Shekhawat, D., 2019. Effect of microwave and thermal co-pyrolysis of low-rank coal and pine wood on product distributions and char structure. Energy & fuels, 33(8), pp. 7069-7082. DOI: https://doi.org/10.1021/acs.energyfuels.9b01105 (Year: 2019).*

Ellison, C., Mullen, C.A. and Elkasabi, Y., 2026. Analytical and experimental study of switchgrass and agricultural plastic co-pyrolysis in a microwave reactor. Fuel, 406, p. 136771. DOI: https://doi.org/10.1016/j.fuel.2025.136771 (Year: 2026).*

Candice Ellison,et al (2018) Dielectric characterization of bentonite clay at various moisture contents and with mixtures of biomass in the microwave spectrum, Journal of Microwave Power and Electromagnetic Energy, 52:1, 3-15, DOI: 10.1080/08327823.2017.1421407 (Year: 2018).*

* cited by examiner

ULTRASONIC EXCITATION AND NITROGEN-INJECTION PRESSURIZATION COUPLING-ENHANCED GAS EXTRACTION DEVICE AND METHOD FOR LOW-GAS COAL SEAM

BACKGROUND OF THE INVENTION

1. Technical Field

The invention belongs to the technical field of gas extraction of coal seams, and particularly relates to an ultrasonic excitation and nitrogen-injection pressurization coupling-enhanced gas extraction device and method for a low-gas coal seam.

2. Description of Related Art

With the continuous improvement of the mechanization level and capacity of mining, the absolute gas emission rate of the working face of some low-gas mines will increase sharply during the high-intensity mining process, leading to a sharp rise in the gas concentration and the occurrence of an out-of-limit gas concentration, seriously affecting safe and efficient production of the mines. The initial coal seam gas content and pressure of these low-gas mines are not high, most pre-extraction boreholes are normal in sealed sections and negative pressure, but the concentration of extracted gas is extremely low, which is specifically manifested by a failure of gas extraction. A measure for solving the problem of a relatively high absolute gas emission rate and an out-of-limit gas concentration at the scene during the mining process of a low-gas mine is to interrupt mining, then blow gas by means of a ventilation system and resume mining after the gas concentration in the working face and the tunnel is decreased to be less than 0.2%. This method not only seriously affects the coordination and balance of the "injection-extraction-excavating-mining" layout of a mine, but also aggravates the pollution of blown gas to the atmosphere, and even induces a gas disaster. In view of this, how to solve the problem of a sharp increase in the absolute gas emission rate of low-gas mines during the high-intensity mining process has become a considerable problem in mine gas disaster prevention and control.

Permeability enhancement of coal seams is an effective method for improving gas extraction efficiency. Existing common permeability enhancement methods include a physical permeability enhancement method and a chemical permeability enhancement method. When applied to low-gas mines with a low gas content and pressure, the chemical permeability enhancement method shows an unsatisfying application effect and often results in pollution of coal seams. The physical permeability enhancement technique can hardly achieve an expected application effect because the hydrofracturing, ultrasonic excitation and presplit blasting techniques cannot solve the problems of low gas pressure and insufficient gas flow power although they can effectively transform a coal reservoir to form an effective facture channel for gas flow, indicating that the purpose of efficient extraction of low-gas mines cannot be fulfilled merely by increasing the permeability of coal seams. Hydrofracturing is a common technique for increasing the permeability of coal seams. However, over 50% of low-gas and low-permeability coal seams in China are soft coal seams, which are high in water sensitivity and will become argillaceous in presence of water and block the gas flow channel, so the permeability enhancement effect of the hydrofracturing technique is often unsatisfactory; in addition, hydrofracturing consumes a large quantity of fresh water resources and generates a large amount of flowback wastewater to be processed in the subsequent mining process of the coal seams, and the flowback wastewater is difficult to process, so the environmental friendliness is poor. The presplit blasting technique for permeability enhancement has a good effect when applied to hard coal seams; however, when it is applied to soft coal seams, the effect is often unsatisfactory, and even secondary disasters may be induced. Ultrasonic excitation, as a new permeability enhancement technique, has the advantages of energy concentration, high penetrability and no pollution and can effectively improve the pore structure of coal seams, enhance pore connectivity and promote desorption of adsorbed gas in the coal seams.

BRIEF SUMMARY OF THE INVENTION

The invention provides a solution to the problem that a sharp rise in the gas concentration of the working face of low-gas mines during the high-intensity mining process affects safe and efficient production of the mines, thus effectively solving the problem of a failure of gas extraction from the low-gas mines by increasing the permeability of the coal seams and the gas flow driving force of the coal seams.

For this purpose, the technical solution adopted by the invention is as follows: an ultrasonic excitation and nitrogen-injection pressurization coupling-enhanced gas extraction device for a low-gas coal seam includes a permeability-enhancement borehole formed in a coal seam and at least two exploration boreholes arranged around the permeability-enhancement borehole. An extraction sieve tube is mounted in each of the boreholes. An ultrasonic excitation and nitrogen-injection pressurization coupling integrated device is mounted in the extraction sieve tube in the permeability-enhancement borehole. Openings of all the boreholes adopt high-pressure sealed holes, and all the boreholes are connected to a gas extraction device outside the boreholes by means of a negative-pressure extraction line.

The ultrasonic excitation and nitrogen-injection pressurization coupling integrated device includes a conical guide and protection head, a rear end of the conical guide and protection head is connected to a front end of an ultrasonic transducer, a front end of a nitrogen injection line and a front end of a high-pressure and corrosion-resistant water tube, the ultrasonic transducer, the nitrogen injection line and the high-pressure and corrosion-resistant water tube are mounted without exceeding a maximum cross-section of the conical guide and protection head, and an ultrasonic reflection port of the ultrasonic transducer, a nitrogen injection nozzle of the nitrogen injection line and a water filling nozzle of the high-pressure and corrosion-resistant water tube all extend out of the extraction sieve tube. The ultrasonic transducer is connected to an ultrasonic excitation control box outside the permeability-enhancement borehole by means of the voltage-resistant and waterproof cable, the nitrogen injection line is connected to a nitrogen-injection storage tank located outside the permeability-enhancement borehole and provided with a pressurization buffer tank, and the high-pressure and corrosion-resistant water tube is connected to a water tank located outside the permeability-enhancement borehole and provided with a water pump.

Control valves are arranged on the negative-pressure extraction line, the nitrogen injection line and the high-pressure and corrosion-resistant water tube.

Meanwhile, the invention further provides an ultrasonic excitation and nitrogen-injection pressurization coupling-enhanced gas extraction method for a low-gas coal seam, adopting the ultrasonic excitation and nitrogen-injection pressurization coupling-enhanced gas extraction device for a low-gas coal seam. The ultrasonic excitation and nitrogen-injection pressurization coupling-enhanced gas extraction method for a low-gas coal seam includes the following steps:

S1, researching and sampling the coal seam, sealing the coal seam and carrying the coal seam back to a laboratory to complete sample preparation;

S2, performing an ultrasonic excitation seepage test, a coal seam displacement test and a permeability enhancement test on a coal sample to respectively determine an optimal ultrasonic frequency f1, a coal seam displacement pressure P1 and a permeability enhancement range R;

S3, drilling extraction boreholes, including the permeability-enhancement borehole and the at least two exploration boreholes, in the coal seam at the scene, and using the permeability enhancement range R of the coal seam determined in S2 as an observation distance between an edge of the permeability-enhancement borehole and an edge of each of the at least two exploration boreholes; and monitoring a gas flow in the permeability-enhancement borehole in a length direction, and determining a position and number of fixed-point permeability-enhancement regions;

S4, mounting the extraction sieve tubes in all the boreholes, forming the high-pressure sealed holes in the openings of all the boreholes, and connecting the boreholes to the gas extraction device outside the boreholes by means of the negative-pressure extraction line;

S5, placing the ultrasonic excitation and nitrogen-injection pressurization coupling integrated device in the permeability-enhancement borehole, arranging the ultrasonic transducer in any one fixed-point permeability-enhancement region, connecting the voltage-resistant and waterproof cable to the ultrasonic excitation control box outside the permeability-enhancement borehole, connecting the nitrogen injection line to the nitrogen-injection storage tank located outside the permeability-enhancement borehole and provided with the pressurization buffer tank, and connecting the high-pressure and corrosion-resistant water tube to the water tank located outside the permeability-enhancement borehole and provided with the water pump;

S6, turning on the water pump and the control valve on the high-pressure and corrosion-resistant water tube to pump clear water into the permeability-enhancement borehole, stopping water injection when backflow of water in the at least two exploration boreholes is observed, and turning off the water pump and the control valve on the high-pressure and corrosion-resistant water tube;

S7, turning on the ultrasonic excitation control box, adjusting an ultrasonic frequency to f1, allowing the ultrasonic transducer to act on the coal seam to perform ultrasonic excitation on the fixed-point permeability-enhancement region, and turning off the ultrasonic excitation control box after the ultrasonic excitation is completed;

S8, turning on a compressor, a nitrogen-injection high-pressure pump truck and the control valve on the nitrogen injection line, wherein a nitrogen injection pressure is maintained at P1, nitrogen reaches the fixed-point permeability-enhancement region along the nitrogen injection line, and a nitrogen injection time t1 is determined according to formula (1):

$$t_1 = {}^{(0.0163_{p1}+0.4361)}\sqrt{R/(0.5072_{p1}+0.5237)} \qquad \text{formula (1)}$$

S9, turning off the control valve on the nitrogen injection line, the compressor and the nitrogen-injection high-pressure pump truck;

S10, moving the ultrasonic excitation and nitrogen-injection pressurization coupling integrated device to the next fixed-point permeability-enhancement region, and repeating S6-S9 to perform coupled "permeability enhancement and pressurization" on the next fixed-point permeability-enhancement region until coupled "permeability enhancement and pressurization" of all the fixed-point permeability-enhancement regions is completed; and

S11, after "permeability enhancement and pressurization" is completed, turning on the control valve on the negative-pressure extraction line to perform gas extraction.

The invention has the following beneficial effects: considering that the gas extraction efficiency of low-gas coal seams is under the combined action of the permeability and the internal gas pressure gradient, the invention proposes ultrasonic excitation and nitrogen-injection pressurization coupling-enhanced gas extraction for low-gas coal seams in the aspects of increasing the permeability of the coal seams and increasing the gas flow driving force of the coal seams; ultrasonic excitation is adopted to improve the fracture structure of coal, promote communication between the fractures and enhance desorption of absorbed gas; on this basis, nitrogen-injection pressurization is adopted to increase the gas flow "driving force" in the coal seams to promote gas flow and improve gas extraction efficiency, thus efficiently solving the problem of a failure of gas extraction from the low-gas coal seams and greatly improving the gas extraction efficiency of the low-gas coal seams.

DETAILED DESCRIPTION OF THE INVENTION

The invention is further described below in conjunction with embodiments and accompanying drawings.

Figure 1:
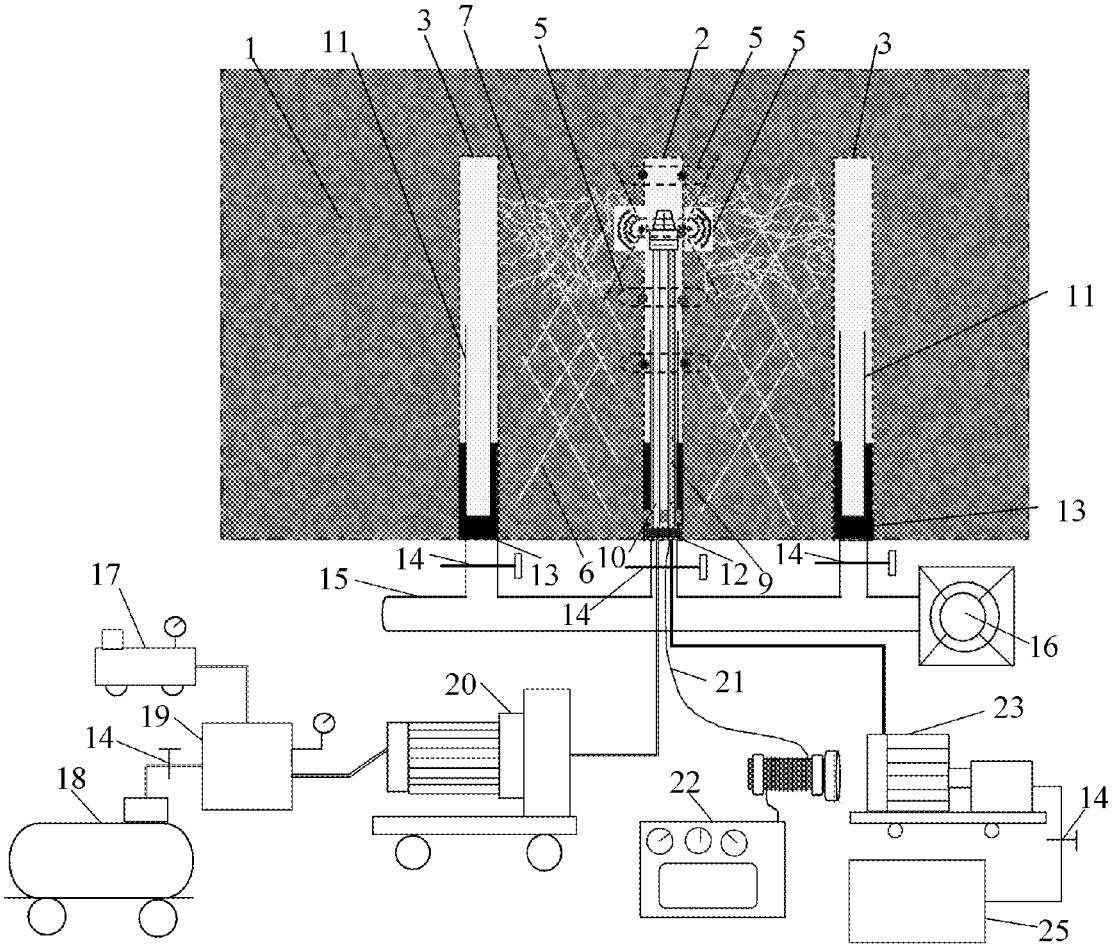
FIG. 1 is a schematic structural diagram according to the invention.
Figure 2:
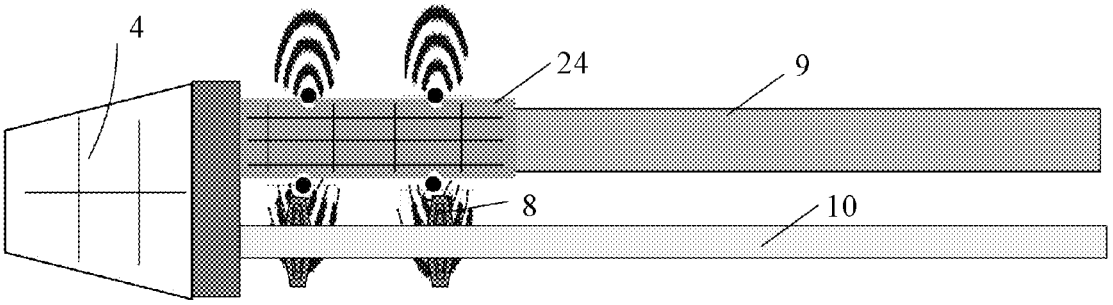
FIG. 2 is a schematic structural diagram of an ultrasonic excitation and nitrogen-injection pressurization coupling integrated device.

As shown in FIGS. 1-2, an ultrasonic excitation and nitrogen-injection pressurization coupling-enhanced gas extraction device for a low-gas coal seam is mainly formed by a permeability-enhancement borehole 2, at least two exploration boreholes 3, a conical guide and protection head 4, fixed-point permeability-enhancement regions 5, a high-pressure and corrosion-resistant water tube 9, a nitrogen injection line 10, extraction sieve tubes 11, a quick high-pressure sealed hole 12, high-pressure capsule sealed holes 13, control valves 14, a negative-pressure extraction line 15, a gas extraction device 16, a compressor 17, a nitrogen-injection storage tank 18, a pressurization buffer tank 19, a nitrogen-injection high-pressure pump truck 20, a voltage-resistant and waterproof cable 21, an ultrasonic excitation control box 22, a water pump 23, an ultrasonic transducer 24 and a water tank 25.

The permeability-enhancement borehole 2 and the at least two exploration boreholes 3 are all formed in a coal seam 1, and the at least two exploration boreholes 3 are arranged around the permeability-enhancement borehole 2. In a case where two exploration boreholes 3 are configured, the two exploration boreholes 3 are respectively located on left and right sides of the permeability-enhancement borehole 2. One extraction sieve tube 11 is mounted in each borehole, and all the boreholes are connected to the gas extraction device 16 outside the boreholes by means of the negative-pressure extraction line 15 to be used for subsequent gas extraction.

An ultrasonic excitation and nitrogen-injection pressurization coupling integrated device is mounted in the extraction sieve tube 11 in the permeability-enhancement borehole 2, and openings of all the boreholes adopt high-pressure sealed holes. Preferably, the high-pressure sealed hole adopted by the permeability-enhancement borehole 2 is the quick high-pressure sealed hole 12, and the high-pressure sealed holes adopted by the at least two exploration boreholes 3 are the high-pressure capsule sealed holes 13.

The ultrasonic excitation and nitrogen-injection pressurization coupling integrated device includes the conical guide and protection head 4. A rear end of the conical guide and protection head 4 is connected to a front end of the ultrasonic transducer 24, a front end of the nitrogen injection line 10 and a front end of the high-pressure and corrosion-resistant water tube 9, and the ultrasonic transducer 24, the nitrogen injection line 10 and the high-pressure and corrosion-resistant water tube 9 are mounted without exceeding a maximum cross-section of the conical guide and protection head 4. The conical guide and protection head 4 is in a conical shape with a small front end and a large rear end. The small front end, when inserted, is used for guiding, and the tail end is used for protecting the ultrasonic transducer 24, the nitrogen injection line 10 and the high-pressure and corrosion-resistant water tube 9.

An ultrasonic reflection port of the ultrasonic transducer 24, nitrogen injection nozzles of the nitrogen injection line 10 and a water filling nozzle of the high-pressure and corrosion-resistant water tube 9 all extend out of the corresponding extraction sieve tube 11, and the nitrogen injection nozzles 8 are arranged at a front end of the nitrogen injection line 10. The ultrasonic transducer 24 is connected to the ultrasonic excitation control box 22 outside the permeability-enhancement borehole 2 by means of the voltage-resistant and waterproof cable 21, the nitrogen injection line 10 is connected to the nitrogen-injection storage tank 18 located outside the permeability-enhancement borehole 2 and provided with the pressurization buffer tank 19, and the high-pressure and corrosion-resistant water tube 9 is connected to the water tank 25 located outside the permeability-enhancement borehole 2 and provided with the water pump 23.

The control valves 14 are arranged on the negative-pressure extraction line 15, the nitrogen injection line 10 and the high-pressure and corrosion-resistant water tube 9.

To be specific, the pressurization buffer tank 19 is connected to the compressor 17; the nitrogen-injection storage tank 18, the pressurization buffer tank 19 and the nitrogen-injection high-pressure pump truck 20 are sequentially connected on the nitrogen injection line 10 outside the permeability-enhancement borehole 2; the control valve 14 on the nitrogen injection line 10 is located between the nitrogen-injection storage tank 18 and the pressurization buffer tank 19; and the pressurization buffer tank 19 and the compressor 17 are respectively provided with pressure gauges. The control valve 14 on the high-pressure and corrosion-resistant water tube 9 is located between the water pump 23 and the water tank 25. Each control valve 14 on the negative-pressure extraction line 15 corresponds to one of the boreholes.

An ultrasonic excitation and nitrogen-injection pressurization coupling-enhanced gas extraction method for a low-gas coal seam adopts the ultrasonic excitation and nitrogen-injection pressurization coupling-enhanced gas extraction device for a low-gas coal seam and includes the following steps:

S1, the coal seam 1 is researched, sampled, sealed and carried back to a laboratory to complete sample preparation.

S2, an ultrasonic excitation seepage test, a coal seam displacement test and a permeability enhancement test are performed on a coal sample to respectively determine an optimal ultrasonic frequency f1, a coal seam displacement pressure P1 and a permeability enhancement range R.

S3, extraction boreholes, including the permeability-enhancement borehole 2 and the at least two exploration boreholes 3, are dilled in the coal seam 1 at the scene, and the permeability enhancement range R of the coal seam determined in S2 is used as an observation distance between an edge of the permeability-enhancement borehole 2 and an edge of each of the at least two exploration boreholes 3; and a gas flow is monitored in the permeability-enhancement borehole 2 in a length direction, and the position and number of the fixed-point permeability-enhancement regions 5 are determined, wherein the number of the fixed-point permeability-enhancement regions 5 is, but not limited to, 3-5.

S4, the extraction sieve tubes 11 are mounted in all the boreholes, the high-pressure sealed holes are formed in the openings of all the boreholes, and the boreholes are connected to the gas extraction device 16 outside the boreholes by means of the negative-pressure extraction line 15.

S5, the ultrasonic excitation and nitrogen-injection pressurization coupling integrated device is placed in the permeability-enhancement borehole 2, the ultrasonic transducer 24 is arranged in any one fixed-point permeability-enhancement region 5, the voltage-resistant and waterproof cable 21 is connected to the ultrasonic excitation control box 22 outside the permeability-enhancement borehole 2, the nitrogen injection line 10 is connected to the nitrogen-injection storage tank 18 located outside the permeability-enhancement borehole 2 and provided with the pressurization buffer tank 19, and the high-pressure and corrosion-resistant water tube 9 is connected to the water tank 25 located outside the permeability-enhancement borehole 2 and provided with the water pump 23.

S6, the water pump 23 and the control valve 14 on the high-pressure and corrosion-resistant water tube 9 are turned on to pump clear water into the permeability-enhancement borehole 2, water injection is stopped when backflow of water in the at least two exploration boreholes 3 is observed, and the water pump 23 and the control valve 14 on the high-pressure and corrosion-resistant water tube 9 are turned off.

S7, the ultrasonic excitation control box 22 is turned on, an ultrasonic frequency is adjusted to f1, the ultrasonic transducer 24 acts on the coal seam 1 to perform ultrasonic excitation on the fixed-point permeability-enhancement region 5, and the ultrasonic excitation control box 22 is turned off after the ultrasonic excitation is completed. Preferably, the ultrasonic excitation lasts for 30-50 min.

S8, the compressor 17, the nitrogen-injection high-pressure pump truck 20 and the control valve 14 on the nitrogen injection line 10 are turned on, wherein a nitrogen injection pressure is maintained at P1, nitrogen reaches the fixed-point permeability-enhancement region 5 along the nitrogen injection line 10, and a nitrogen injection time t1 is determined according to formula (1):

$$t_1 = {}^{(0.0163_{p1}+0.4361)}\sqrt{R/(0.5072_{p1}+0.5237)} \qquad \text{formula (1)}$$

S9, the control valve 14 on the nitrogen injection line 10, the compressor 17 and the nitrogen-injection high-pressure pump truck 20 are turned off.

S10, the ultrasonic excitation and nitrogen-injection pressurization coupling integrated device is moved to the next fixed-point permeability-enhancement region 5, and S6-S9 are repeated to perform coupled "permeability enhancement and pressurization" on the next fixed-point permeability-enhancement region 5 until coupled "permeability enhancement and pressurization" of all the fixed-point permeability-enhancement regions 5 is completed.

S11, after "permeability enhancement and pressurization" is completed, the control valve 14 on the negative-pressure extraction line 15 is turned on to perform gas extraction.

Preferably, "permeability enhancement and pressurization" of the fixed-point permeability-enhancement regions 5 is performed in the permeability-enhancement borehole 2 from bottom to top. Natural fractures 6 exist in the coal seam 1, and permeability-enhancement fractures 7 are generated after ultrasonic excitation and nitrogen-injection pressurization coupling enhancement.

Considering the low permeability, low gas content and low gas pressure in low-gas coal seams, ultrasonic excitation and nitrogen-injection pressurization are organically combined to perform permeability enhancement and pressurization on the low-gas coal seams. Ultrasonic excitation, as a new permeability enhancement technique, has the advantages of energy concentration, high penetrability and no pollution and can effectively improve the pore structure of coal seams, enhance pore connectivity and promote desorption of adsorbed gas in the coal seams. Nitrogen, as an inert gas and a low-adsorption gas, is the optimal gas for the gas-injection pressurization method, considering from safety and economy. In view of this, the invention provides the ultrasonic excitation and nitrogen-injection pressurization coupling-enhanced gas extraction device and technique for a low-gas coal seam, the mechanical vibration effect generated by ultrasonic excitation, the cavitation effect and the thermal effect act on coal jointly to improve the pore structure of the coal and promote gas to be desorbed from the surface of the coal, a large number of micro-fractures are produced in the coal, and secondary fractures and primary fractures communicate with each other continuously to form more gas flow channels; and then, high-pressure nitrogen is injected into the coal seam to provide sufficient power for gas migration inside to realize efficient gas extraction.

The ultrasonic excitation and nitrogen-injection pressurization coupling effect reflected in the following two aspect: in one aspect, the ultrasonic excitation effect changes the pore and fracture structure of the coal seam, increases the content of free gas in coal and promotes micropores and mesopores in the coal to communicate gradually to form macropores or macro-fractures, and the fractures communicate with each other. The number of macropores and macro-fractures in the coal seam is increased, and the permeability of the coal seam is increased. The coal fracture system is a main gas flow channel, and the gas flow follows the Darcy law:

$$q = -k_D \nabla p/\mu \qquad \text{formula (2)}$$

where, q is a gas flow rate, m/s; $k_D$ is a coal permeability, $m^2$; p is a gas pressure, MPa; μ is a dynamic viscosity, Pa·s.

It may be known from formula (2) that the gas flow rate is in direct proportion to the pressure gradient, so the pore pressure in coal is increased by injecting high-pressure nitrogen into the coal seam, thus effectively solving the problem of insufficient gas flow power.

In the other aspect, when ultrasonic excitation is applied to the coal, a large number of fractures for gas flow is formed in the coal, and the fracture aperture affects, to a large extent, the gas flow efficiency. According to the effective stress formula (formula 3) of the coal under dual media, the fracture aperture is a dynamic parameter determined by the external stress and the internal pressure of the coal. Under normal circumstances, the low gas pressure in the coal seam, the insufficient gas flow driving force in the coal seam and the low fracture aperture in the coal seam lead to a decrease in the permeability of the coal seam. After high-pressure nitrogen is injected into the coal seam, the gas pressure in the coal seam splits the coal and effectively prevents the fracture aperture from decreasing, thus keeping the gas flow channels unblocked.

$$\sigma_{ij}^{e} = \sigma_{ij} - (\alpha_f p_f + \alpha_p p_p)\delta_{ij} \qquad \text{formula (3)}$$

where, $$\sigma_{ij}^{e}$$

is all effective stress, MPa, $\sigma_{ij}$ is an external stress applied to the coal, MPa; $\alpha_f$ and $\alpha_p$ are respectively an effective coefficient of fractures and an effective coefficient of pores; and $p_f$ and $p_p$ are respectively a gas pressure in the fractures and a gas pressure in the pores.

What is claimed is:

1. An ultrasonic excitation and nitrogen-injection pressurization coupling-enhanced gas extraction method for a low-gas coal seam, adopting an ultrasonic excitation and nitrogen-injection pressurization coupling-enhanced gas extraction device for the low-gas coal seam, wherein the ultrasonic excitation and nitrogen-injection pressurization coupling-enhanced gas extraction device for the low-gas coal seam comprises a permeability-enhancement borehole (2) formed in the low-gas coal seam (1) and at least two exploration boreholes (3) arranged around the permeability-enhancement borehole (2);

wherein an extraction sieve tube (11) is mounted in each of the boreholes, an ultrasonic excitation and nitrogen-injection pressurization coupling integrated device is mounted in the extraction sieve tube (11) in the permeability-enhancement borehole (2), openings of all the boreholes adopt high-pressure sealed holes, and all the boreholes are connected to a gas extraction device (16) outside all the boreholes by means of a negative-pressure extraction line (15);

wherein the ultrasonic excitation and nitrogen-injection pressurization coupling integrated device comprises a conical guide and protection head (4), a rear end of the conical guide and protection head (4) is connected to a front end of an ultrasonic transducer (24), a front end of a nitrogen injection line (10) and a front end of a high-pressure and corrosion-resistant water tube (9);

wherein the ultrasonic transducer (24), the nitrogen injection line (10) and the high-pressure and corrosion-resistant water tube (9) are mounted without exceeding a maximum cross-section of the conical guide and protection head (4), and an ultrasonic reflection port of the ultrasonic transducer (24), a nitrogen injection nozzle of the nitrogen injection line (10) and a water filling nozzle of the high-pressure and corrosion-resistant water tube (9) all extend out of the extraction sieve tube (11);

wherein the ultrasonic transducer (24) is connected to an ultrasonic excitation control box (22) outside the permeability-enhancement borehole (2) by means of the voltage-resistant and waterproof cable (21), the nitrogen injection line (10) is connected to a nitrogen-injection storage tank (18) located outside the permeability-enhancement borehole (2) and provided with a pressurization buffer tank (19), and the high-pressure and corrosion-resistant water tube (9) is connected to a water tank (25) located outside the permeability-enhancement borehole (2) and provided with a water pump (23);

wherein control valves (14) are arranged on the negative-pressure extraction line (15), the nitrogen injection line (10) and the high-pressure and corrosion-resistant water tube (9);

wherein the ultrasonic excitation and nitrogen-injection pressurization coupling-enhanced gas extraction method for the low-gas coal seam comprises the following steps:

S1, researching and sampling the low-gas coal seam (1) to form a coal sample, sealing the coal sample and carrying the coal sample back to a laboratory to complete sample preparation;

S2, performing an ultrasonic excitation seepage test, a coal seam displacement test and a permeability enhancement test on the coal sample to respectively determine an optimal ultrasonic frequency f1, a coal seam displacement pressure P1 and a permeability enhancement range R;

S3, drilling extraction boreholes, comprising the permeability-enhancement borehole (2) and the at least two exploration boreholes (3), in the low-gas coal seam (1) at a scene, and using the permeability enhancement range R of the coal seam determined in S2 as an observation distance between an edge of the permeability-enhancement borehole (2) and an edge of each of the at least two exploration boreholes (3); and monitoring a gas flow in the permeability-enhancement borehole (2) in a length direction, and determining a position and number of fixed-point permeability-enhancement regions (5);

S4, mounting the extraction sieve tubes (11) in all the boreholes, forming the high-pressure sealed holes in the openings of all the boreholes, and connecting all the boreholes to the gas extraction device (16) outside all the boreholes by means of the negative-pressure extraction line (15);

S5, placing the ultrasonic excitation and nitrogen-injection pressurization coupling integrated device in the permeability-enhancement borehole (2), arranging the ultrasonic transducer (24) in any one said fixed-point permeability-enhancement region (5), connecting the voltage-resistant and waterproof cable (21) to the ultrasonic excitation control box (22) outside the permeability-enhancement borehole (2), connecting the nitrogen injection line (10) to the nitrogen-injection storage tank (18) located outside the permeability-enhancement borehole (2) and provided with the pressurization buffer tank (19), and connecting the high-pressure and corrosion-resistant water tube (9) to the water tank (25) located outside the permeability-enhancement borehole (2) and provided with the water pump (23);

S6, turning on the water pump (23) and the control valve (14) on the high-pressure and corrosion-resistant water tube (9) to pump clear water into the permeability-enhancement borehole (2), stopping water injection when backflow of water in the at least two exploration boreholes (3) is observed, and turning off the water pump (23) and the control valve (14) on the high-pressure and corrosion-resistant water tube (9);

S7, turning on the ultrasonic excitation control box (22), adjusting an ultrasonic frequency to f1, allowing the ultrasonic transducer (24) to act on the low-gas coal seam (1) to perform ultrasonic excitation on the fixed-point permeability-enhancement region (5), and turning off the ultrasonic excitation control box (22) after the ultrasonic excitation is completed;

S8, turning on a compressor (17), a nitrogen-injection high-pressure pump truck (20) and the control valve (14) on the nitrogen injection line (10), wherein a nitrogen injection pressure is maintained at P1, nitrogen reaches the fixed-point permeability-enhancement region (5) along the nitrogen injection line (10), and a nitrogen injection time t1 is determined according to formula (1):

$$t_1 = {}^{(0.0163_{p1}+0.4361)}\sqrt{R/(0.5072_{p1}+0.5237)} \qquad \text{formula (1)}$$

S9, turning off the control valve (14) on the nitrogen injection line (10), the compressor (17) and the nitrogen-injection high-pressure pump truck (20);

S10, moving the ultrasonic excitation and nitrogen-injection pressurization coupling integrated device to the next fixed-point permeability-enhancement region (5), and repeating S6-S9 to perform coupled "permeability enhancement and pressurization" on the next fixed-point permeability-enhancement region (5) until coupled "permeability enhancement and pressurization" of all the fixed-point permeability-enhancement regions (5) is completed; and S11, after "permeability enhancement and pressurization" is completed, turning on the control valve (14) on the negative-pressure extraction line (15) to perform gas extraction.

2. The ultrasonic excitation and nitrogen-injection pressurization coupling-enhanced gas extraction method for the low-gas coal seam according to claim 1, wherein the high-pressure sealed holes adopted by the at least two exploration boreholes (3) are high-pressure capsule sealed holes (13).

3. The ultrasonic excitation and nitrogen-injection pressurization coupling-enhanced gas extraction method for the low-gas coal seam according to claim 1, wherein the at least two exploration boreholes (3) are arranged around the permeability-enhancement borehole (2) and respectively located on left and right sides of the permeability-enhancement borehole (2).

4. The ultrasonic excitation and nitrogen-injection pressurization coupling-enhanced gas extraction method for the low-gas coal seam according to claim 1, wherein the pressurization buffer tank (19) is connected to the compressor (17); the nitrogen-injection storage tank (18), the pressurization buffer tank (19) and the nitrogen-injection high-pressure pump truck (20) are sequentially connected on the nitrogen injection line (10) outside the permeability-enhancement borehole (2); the control valve (14) on the nitrogen injection line (10) is located between the nitrogen-injection storage tank (18) and the pressurization buffer tank (19); and the pressurization buffer tank (19) and the compressor (17) are respectively provided with pressure gauges.

5. The ultrasonic excitation and nitrogen-injection pressurization coupling-enhanced gas extraction method for the low-gas coal seam according to claim 1, wherein the control valve (14) on the high-pressure and corrosion-resistant water tube (9) is located between the water pump (23) and the water tank (25), and each said control valve (14) on the negative-pressure extraction line (15) corresponds to one of the at least two exploratory boreholes or the permeability enhancement borehole.

6. The ultrasonic excitation and nitrogen-injection pressurization coupling-enhanced gas extraction method for the low-gas coal seam according to claim 1, wherein in S7, the ultrasonic excitation lasts for 30-50 minuties.

7. The ultrasonic excitation and nitrogen-injection pressurization coupling-enhanced gas extraction method for the low-gas coal seam according to claim 1, wherein "permeability enhancement and pressurization" of the fixed-point permeability-enhancement regions (5) is performed in the permeability-enhancement borehole (2) from bottom to top.

* * * * *